US009126785B2

(12) United States Patent
Redmer et al.

(10) Patent No.: US 9,126,785 B2
(45) Date of Patent: Sep. 8, 2015

(54) SUCTION TRANSPORT DEVICE AND METHOD FOR TAKING OFF A SHEET FROM A SHEET STACK

(71) Applicant: Maschinenbau Oppenweiler Binder GmbH & Co. KG, Oppenweiler (DE)

(72) Inventors: Claus-Dieter Redmer, Oppenweiler (DE); Klaus Dieter Siegmund, Untergruppenbach (DE)

(73) Assignee: Maschinenbau Oppenweiler Binder GmbH & Co. KG, Oppenweiler (DE)

( * ) Notice: Subject to any disclaimer, the term of this patent is extended or adjusted under 35 U.S.C. 154(b) by 40 days.

(21) Appl. No.: 13/870,392

(22) Filed: Apr. 25, 2013

(65) Prior Publication Data

US 2013/0309058 A1 Nov. 21, 2013

(30) Foreign Application Priority Data

May 3, 2012 (DE) ..... 10 2012 207 320

(51) Int. Cl.
*B65H 3/12* (2006.01)

(52) U.S. Cl.
CPC ..... *B65H 3/128* (2013.01); *B65H 3/12* (2013.01); *B65H 3/124* (2013.01); *B65H 2404/2641* (2013.01); *B65H 2801/21* (2013.01)

(58) Field of Classification Search
CPC ..... B65H 3/124; B65H 3/128; B65H 3/10; B65H 2404/2641; B65H 3/12
USPC ..... 271/11, 12, 94, 95, 10.03, 270, 5, 112
See application file for complete search history.

(56) References Cited

U.S. PATENT DOCUMENTS

| | | | | |
|---|---|---|---|---|
| 1,637,019 | A * | 7/1927 | Broadmeyer | 271/95 |
| 2,645,479 | A * | 7/1953 | Mitchell | 271/91 |
| 6,773,006 | B2 * | 8/2004 | Andreyka et al. | 271/96 |
| 7,722,027 | B2 * | 5/2010 | Gibson et al. | 271/12 |
| 7,845,629 | B2 * | 12/2010 | Mitsuya et al. | 271/11 |
| 8,157,256 | B2 * | 4/2012 | Mitsuya et al. | 271/5 |

FOREIGN PATENT DOCUMENTS

DE 2637073 A1 2/1978

* cited by examiner

*Primary Examiner* — Luis A Gonzalez
(74) *Attorney, Agent, or Firm* — Bachman & LaPointe, P.C.

(57) ABSTRACT

The suction transport device for taking off a sheet from a sheet stack in a sheet running direction (BL) includes at least two revolving suction means (12, 14) which are mounted to be adjustable horizontally and transversally to the sheet running direction.

8 Claims, 1 Drawing Sheet

SUCTION TRANSPORT DEVICE AND METHOD FOR TAKING OFF A SHEET FROM A SHEET STACK

BACKGROUND OF THE INVENTION

The invention relates to a suction transport device for taking off a sheet from a sheet stack in a sheet running direction, which includes at least two revolving suction means, as well as a method for taking off sheets.

DE 26 37 073 A1 discloses a sheet feeder for folding machines in which a suction transport device is provided which includes a continuously revolving suction wheel having a horizontal axis of rotation which is transversal to the sheet running direction. By means of the suction wheel a topmost sheet on a sheet stack is grabbed and transported further to a processing machine, such as a folding machine.

In the case of suction transport devices comprising only a single suction wheel it has often been experienced that a sheet gets into a skew position, resulting in the fact that the sheet is not adequately transported further. For this reason it has become customary to provide suction transport devices with two suction wheels which are firmly installed at an equal distance from the center line of a sheet. These two suction wheels are used for all kinds of sheet sizes, from large to small. Especially in the case of very large sheets it may happen that for reasons of inertia the margins of a sheet are transported at a lower speed than the regions in which the suction wheels engage. This may lead to undesired deformation of a sheet.

The object underlying the invention is to provide a suction transport device using means of simple design by which sheets of different sizes can be reliably taken off from a sheet stack.

SUMMARY OF THE INVENTION

This object is achieved by a suction transport device for taking off a sheet from a sheet stack in a sheet running direction, comprising at least two revolving suction means, wherein said at least two suction means are mounted to be adjustable horizontally and transversally to the sheet running direction.

In the case of the suction transport device according to the invention two suction means are mounted to be adjustable horizontally and transversally to the sheet running direction. This enables to decrease or increase the distance between the two suction means depending on the size of the sheet to be taken off. Due to this it is ensured that sheets of many different sizes are reliably and exactly transported further to a processing machine.

Preferably the adjustable suction means are mounted on a drive shaft to be displaceable transversally to the sheet running direction and in a rotationally fixed manner in order that they can be driven by a single drive only.

In a preferred embodiment, a fixed suction means having the same distance from each of the adjustable suction means is provided in the middle between the adjustable suction means. With a suction transport device of this kind even very small sheets can be reliably taken off.

In the case of a further preferred embodiment, the drive shaft is driven by a servomotor controlled by a controller. The controller is configured to control the servomotor such that for taking off a sheet from a sheet stack the suction means are charged with suction air and the suction means are initially rotated at minimal rotational speed; the suction means are then accelerated to a maximal rotational speed; the maximal rotational speed is then maintained over a predetermined period of time; and the suction air is then turned off and the suction means are decelerated to the initial minimal rotational speed.

By controlling the servomotor in this way it is ensured that no inertia effects occur at the margins of the sheet, which may lead to warping of the sheet.

Preferably, the two adjustable suction means are each formed by a suction belt and the fixed suction means is formed by a suction roller.

BRIEF DESCRIPTION OF THE DRAWINGS

Hereinafter an exemplary embodiment of the invention will be described in more detail with reference to the accompanying drawings, in which.

DETAILED DESCRIPTION

Figure 1:
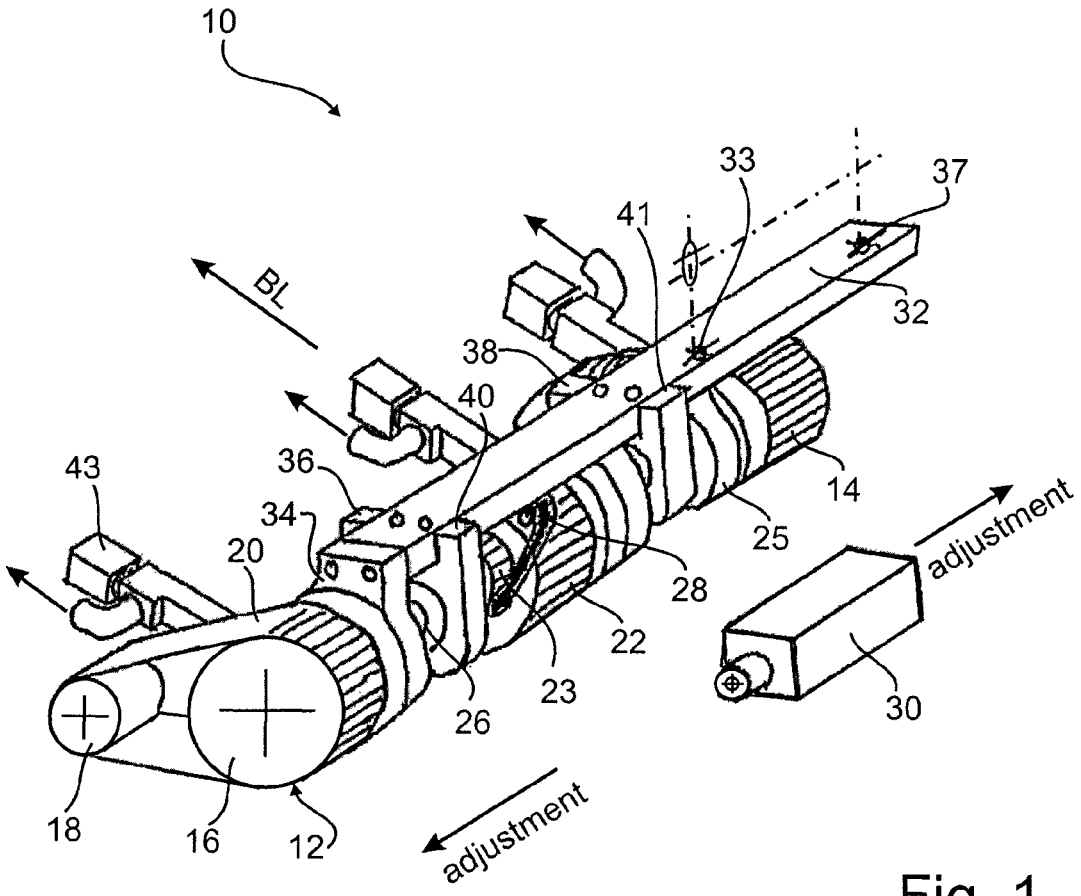
FIG. 1 shows a perspective view of a suction transport device.

The suction transport device 10 includes two suction belts 12, 14 arranged horizontally at a distance from one another and a suction roller 22 arranged in the middle between the two suction belts 12, 14. Each of the two suction belts 12, 14 includes a small roller 18 and a larger roller 16, which are surrounded by an endless belt 20. The rollers 16 of the suction belts 12, 14 rest on a common drive shaft 26 in a rotationally fixed manner and are axially displaceable on the drive shaft 26.

A drive pinion 23 is mounted adjacently to the suction roller 22 in a rotationally fixed manner on the drive shaft 26 and is made to rotate via an endless toothed belt 28 by a servomotor 30 shown in FIG. 1 in an exploded view for reasons of clarity. The suction belts 12, 14 and the suction roller 22 are each connected via a suction line 43 to a vacuum device.

The drive shaft 26 passes through fixed bearing blocks 36, 38 which are arranged at both sides of the suction roller 22. At the top side of the bearing blocks there are formed rectangular guide recesses 40, 41 in which a push bar 32 is guided such that it is displaceable horizontally and transversally to the sheet running direction BL. The suction belt 12 is mounted on a support 34 which is attached to the left end side of the push bar 32 in FIG. 1. As shown in FIG. 1, a corresponding support 25 is screwed from below onto the push bar 32 at a fixing point 33 adjacent to the bearing block 38. The push bar 32 has another fixing point 37 adjacent to the right end of the push bar 32 shown in FIG. 1.

The position of the suction belts 12, 14 shown in FIG. 1 is suitable for taking off sheets of smaller size. If sheets of larger size are to be taken off, the distance between the suction belts 12, 14 and the suction roller 22 can be varied by displacing the push bar 32 to the left, thereby also moving the suction belt 12 to the left. The support 25 of the suction belt 14 is then secured at the fixing point 37. Herein the push bar 32 is displaced such that both suction belts 12, 14 have the same distance from the suction roller 22.

Figure 2:
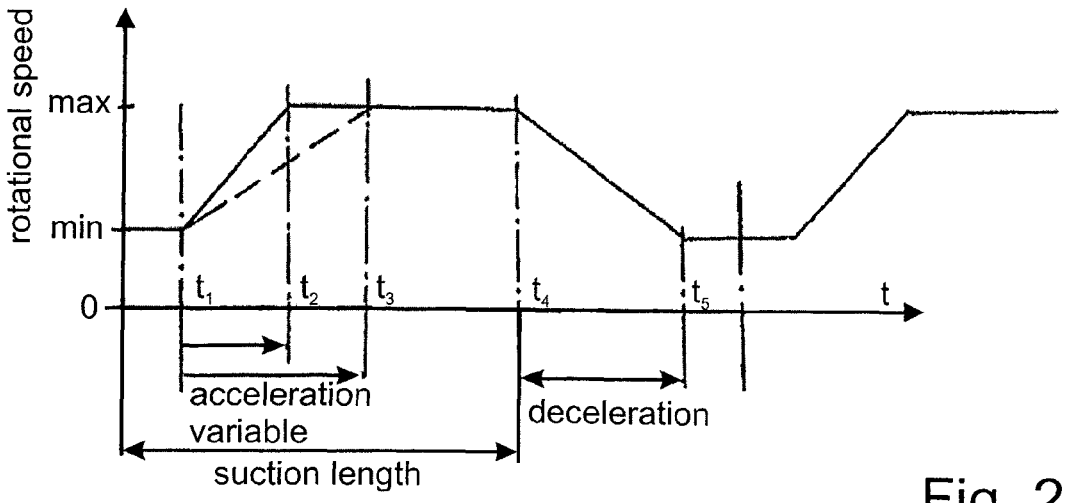
FIG. 2 shows the rotational speed curve of suction means when taking off a sheet.

The servomotor 30 is driven by a controller (not shown) as illustrated in the diagram of rotational speed over time of FIG. 2. At time 0 the rotational speed of the two suction belts 12, 14 and the suction roller 22 is minimal and they are charged with suction air. At this time the suction belts 12, 14 and the suction roller 22 may also be standing still. From time $t_1$ on the suction belts 12, 14 and the suction roller 22 are accelerated up to a maximal rotational speed at time $t_2$. This maximal rotational speed is then maintained up to time $t_4$ when the suction air is turned off. Thereafter the suction belts 12, 14 and the suction roller 22 are decelerated until finally the initial minimal rotational speed is reached. As shown by the dashed line between times $t_1$ and $t_3$, the configuration of the acceleration may be variable.

The adjustment option by means of the push rod as described is only one of many conceivable possible ways of adjusting the suction belts. Of course it is possible to realize the adjustment, for example, by means of drives which are also controlled by the controller.

In the exemplary embodiment described one suction roller 22 and two suction belts 12, 14 are provided. However it is also conceivable to realize other embodiments which use only a pair of adjustable suction belt and suction roller.

The invention claimed is:

1. A suction transport device for taking off a sheet from a sheet stack in a sheet running direction, comprising at least two revolving suction means, said at least two suction means are mounted to be adjustable horizontally and transversally to the sheet running direction, and a fixed suction means having the same distance from each of said adjustable suction means is provided in the middle between said adjustable suction means.

2. The suction transport device as claimed in claim 1, wherein said adjustable suction means are displaceable transversally to said sheet running direction and are mounted on a drive shaft in a rotationally fixed manner.

3. The suction transport device as claimed in claim 2, wherein said drive shaft is driven by a servomotor controlled by a controller, wherein said controller is configured to control said servomotor such that for taking off a sheet from a sheet stack said suction means are charged with suction air and said suction means are initially rotated at minimal rotational speed;

said suction means are then accelerated to a maximal rotational speed;

said maximal rotational speed is then maintained over a predetermined period of time;

the suction air is then turned off and said suction means are decelerated to said initial minimal rotational speed.

4. The suction transport device as claimed in claim 3, wherein said minimal rotational speed is zero.

5. The suction transport device as claimed in claim 1, wherein said adjustable suction means are each formed by a suction belt and said fixed suction means is formed by a suction roller.

6. A suction transport device for taking off a sheet from a sheet stack in a sheet running direction, comprising at least two revolving suction means, wherein said at least two suction means are mounted to be adjustable horizontally and transversally to the sheet running direction, wherein said adjustable suction means are displaceable transversally to said sheet running direction and are mounted on a drive shaft in a rotationally fixed manner and wherein said drive shaft is driven by a servomotor controlled by a controller, wherein said controller is configured to control said servomotor such that for taking off a sheet from a sheet stack said suction means are charged with suction air and said suction means are initially rotated at minimal rotational speed;

said suction means are then accelerated to a maximal rotational speed;

said maximal rotational speed is then maintained over a predetermined period of time;

the suction air is then turned off and said suction means are decelerated to said initial minimal rotational speed.

7. The suction transport device as claimed in claim 6, wherein a fixed suction means having the same distance from each of said adjustable suction means is provided in the middle between said adjustable suction means.

8. The suction transport device as claimed in claim 6, wherein said minimal rotational speed is zero.

* * * * *